US005167262A

United States Patent [19]

Bennett et al.

[11] Patent Number: 5,167,262

[45] Date of Patent: Dec. 1, 1992

[54] JOIN LENGTH FOR ENDLESS FLAT WOVEN PAPERMAKERS FABRIC

[75] Inventors: Jinan G. Bennett, Greenwood; C. Lee Dilday, Jr., Greenville; William S. Summer, Jr., Joanna, all of S.C.

[73] Assignee: Asten Group, Inc., Charleston, S.C.

[21] Appl. No.: 660,515

[22] Filed: Feb. 22, 1991

[51] Int. Cl.[5] ..... D03D 3/04

[52] U.S. Cl. ..... 139/383 AA; 428/234; 428/300

[58] Field of Search ..... 439/383 AA; 428/234, 428/300

[56] References Cited

U.S. PATENT DOCUMENTS 4,771,814 9/1988 Quigley ..... 139/383 AA
4,883,096 11/1989 Penven ..... 139/383 AA
4,985,970 1/1991 Krenkel et al. ..... 139/383 AA

*Primary Examiner*—Andrew M. Falik
*Attorney, Agent, or Firm*—Volpe and Koenig

[57] ABSTRACT

A seam for a papermakers wet press felt having a flat woven base fabric with the crimped yarns oriented in a lengthwise or machine direction. Orientation of the crimp in the machine direction lends itself to an analysis of the crimps per square inch based upon the crimp length and warp end count. Utilizing the crimps per square inch figure, it is possible to establish the approximate minimum length of the join in the machine direction. The machine direction length, in inches, of the join area is approximated by the equation: approximate joined length equals 500 divided by the crimps per square inch in the repeat pattern of the woven base fabric.

4 Claims, 1 Drawing Sheet

JOIN LENGTH FOR ENDLESS FLAT WOVEN PAPERMAKERS FABRIC

BACKGROUND OF THE INVENTION

1. Field of the Invention

The present invention relates generally to the joining of flat woven fabrics to render them endless. More particularly, the invention relates to joining papermakers wet press felt base fabrics to render them endless. Most particularly, the present invention relates to joining flat woven papermakers wet press felt base fabrics having crimped machine direction yarns.

2. Description of the Prior Art

It is known to join a flat woven fabric in order to render it endless. In the earliest fabrics, the woven yarns were generally natural fibers, such as cotton, wool and combinations thereof. Due to the nature of the natural fiber, the joined area receives some of its mechanical strength from the natural resistance of the fibers pulling past each other and additional strength from the fiber migration which took place during fulling of the felt. The join area in these fabrics are generally quite large and may extend over several feet.

With the advent of synthetic monofiliments which have more regular and smoother surface characteristics, thee was a tremendous reduction in the mechanical strength attributable to fiber movement resistance. Similarly, the practice of fulling was no longer part of the finishing operations for the press felt. Accordingly, the mechanical strength generally associated with fiber entanglement as a result of fulling was no longer a major factor in seam strength.

As a result of the above, the art developed a number of joining techniques to produce the required mechanical strength. One of the principle drawbacks of the prior art join was the large joining area which was still necessary to accomplish mechanical strength. It is believed that the need for a large join area is directly related to the weave construction of the prior art fabrics wherein the crimp was generally in the cross machine direction yarns and a number of cross machine direction yarns had to be involved in order to accomplish the joining structure. Although the synthetic monofiliments generally maintain their crimp memory, lack of crimp in the machine or running direction of the fabric necessitated large joining areas. The length of the fabric seam is generally determined by the same strength which is necessary to maintain the fabric under the running load or tension associated with fabric operation. It is not uncommon to have a fabric running load of 20 pli (pounds per lineal inch). Under this load, the typical press felt fabric would have a minimum seam length of about ten (10) inches.

In view of the above, efforts were undertaken to reduce the size of the join area and to improve the uniformity in the join area. Along with improved uniformity and reduced size, the art desired a join which had improved resiliency to compression in the nip area of the papermaking machine. It was found that the use of machine direction crimp in the flat woven fabric produced a crimp pattern which accurately reflected the fabric weave. Once the woven fabric was heat set, the machine direction yarns have a fixed memory of the crimp pattern which means that the join area may be rewoven in the precise pattern of the original flat woven fabric. As a result, the endless fabric will have substantially the identical pattern, caliper and air permeability through its length.

The warp yarns are crimped as a result of the inner weaving with cross machine direction yarns and heat setting. The yarn memory for this crimp permits reweaving of the fabric to join the fabric ends to achieve mechanical strength based on the initial crimp patterns established during the weaving. In this manner, the resultant fabric join area establishes essentially the same weave pattern as if the pattern had been woven endless in the first instance. However, fabrics according to the present invention can include much higher machine direction yarn counts then would be available with a similar fabric which had been woven endless.

SUMMARY OF THE INVENTION

The present invention provides a papermakers wet press felt having a flat woven base fabric with the crimped yarns oriented in the lengthwise or machine direction. Orientation of the crimp in the machine direction lends itself to an analysis of the crimps per square inch based upon crimp length and warps end count. Utilizing the crimp per square inch figure, it is possible to establish the approximate length of the join in the machine direction.

Based on the above analysis of crimps per square inch, the machine direction length of the join area is approximated by the equation: approximate join length equals 500 divided by the crimps per square inch in the repeat pattern of the base fabric.

DESCRIPTION OF THE PREFERRED EMBODIMENTS

Figure 1:
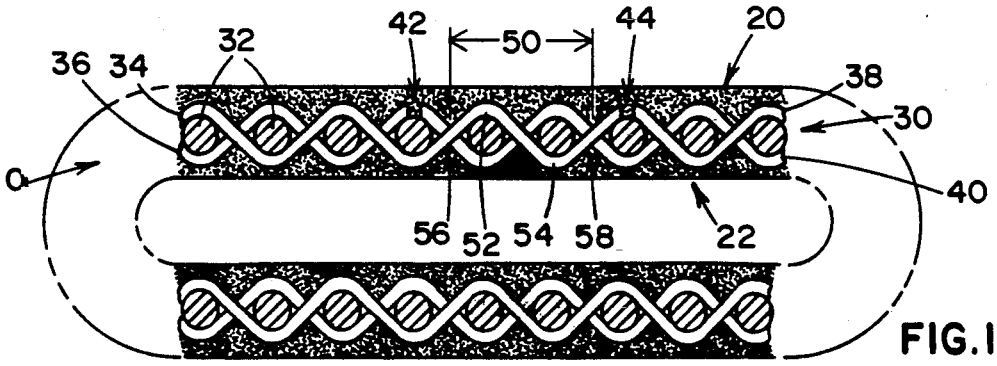
FIG. 1 is a side elevation which illustrates a single layer plain weave fabric having crimped machine yarns which are joined; the cross machine direction yarns are shown in section.

Although specific weave patterns and constructions have been selected for illustration in the drawings and the following description refers in specific terms to those drawings, it will be understood that the description is not intended to limit the scope of the invention to the specific weave patterns and constructions shown.

With reference to FIG. 1, there is shown a papermakers wet press felt 10, which includes a batt layer 20 on the sheet or paper carrying surface, and a batt layer 22 on the machine side surface of the felt. The felt 10 also includes a flat woven base fabric 30. Base fabric 30 is comprised of a plurality of cross machine direction yarns 32, which are interwoven in the usual fashion with a plurality of machine direction yarns. Through the use of the join shown in FIG. 1, a flat woven fabric is rendered endless. In order to render the fabric endless, the machine direction yarns 34 and 36, from a first end of the flat woven fabric, have been rewoven or backwoven so as to abut machine direction yarns 38 and 40 of what previously constituted the other end of the flat woven fabric. The techniques for rendering fabrics endless in this method will be known to the skill in the art. Likewise, those skilled in the art will recognize that the yarn abutments 42 and 44 should be staggered throughout the join area and spaced from each other. The length of the join area is determined as the maximum machine direction distance between two sets of yarn abutments.

In the present application to papermakers wet press felts, it is preferred that the join areas 42 and 44 be completed on the face or sheet side 20 of the felt 10. Since the potential does exist for the end of a joined yarn to back out of the fabric, it is preferred that the join take place at the face or sheet side of the fabric. In case a yarn does back out of the construction, the loose end of the yarn will then be disposed away from the product and on the machine side of the press felt 10.

As noted above, the techniques for joining the fabric endless are known in the prior art. In addition, it is believed that some single layer forming fabrics have been rendered endless through the use of backweaving techniques employing machine direction yarns which were crimped during the flat weaving process. However, those fabrics were not subjected to nip pressure, which can have a highly detrimental effect upon the integrity of the join area.

Still with reference to FIG. 1, it will be recognized by those skilled in the art that the illustrated construction is a plain weave. In such a plain weave, the machine direction yarns will form a crimp 50 after interweaving with two cross machine direction yarns. Accordingly, the crimp 50 has a length which includes two knuckles, 52 and 54, which form on opposite planes or surfaces of the base fabric 30. The length of the crimp 50 is measured between the points 56 and 58 where the yarn intersects the center line through the base fabric 30.

In addition to considerations regarding the number of crimps per inch in the machine direction yarns, it is necessary to consider the number of ends or machine direction yarns which are adjacent to each other in one inch of cross machine direction width. Based upon this relationship, and full consideration of the weave construction, it is possible to establish the join area which will be necessary for a given construction. In order to more fully understand the invention, reference is made to the following example.

In a sample fabric, which was a single layer plain weave fabric having fifteen picks per inch of 0.019" diameter monofilament, each inch of machine direction yarn interacted with approximately fifteen picks or cross machine direction yarns. In appreciation of the fact that each crimp requires two knuckles, a plain weave of this type yielded approximately 7.5 crimps per inch of machine direction yarn. The machine direction yarn count was approximately thirty, six ends per inch of 0.019" diameter monofilaments. Based on these yarn counts, each square inch of fabric yields approximately 270 crimps. With this fabric construction, it was found that a suitable join could be established across the width of the fabric over a maximum machine direction length of 4.5 inches.

Figure 2:
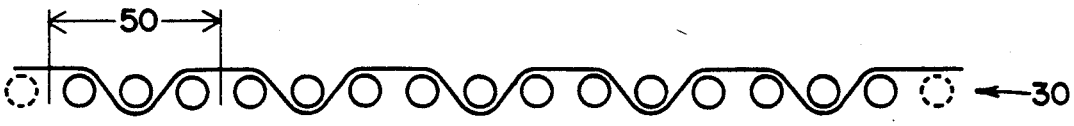
FIG. 2 is similar to FIG. 1 and illustrates a two over-one under fabric.
Figure 3:
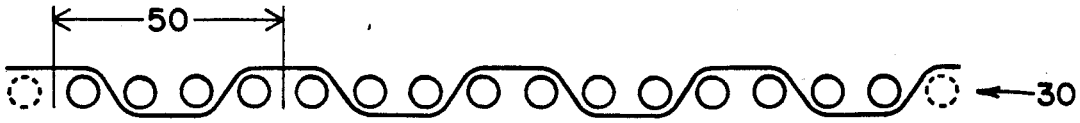
FIG. 3 is similar to FIG. 1 and illustrates a two over-two under fabric.

With reference to FIGS. 2 and 3, it can be seen that as the construction of the base fabric 30 is modified to include longer floats on one or both surfaces, the length of crimp 50 increases. Accordingly, the number of crimps available per inch of machine direction yarn is reduced. In the construction of FIG. 2 of over two and under one, there are approximately 5 crimps per inch. In the construction of FIG. 3 which is an over two, under two construction, there are approximately 4 crimps per inch. As can be appreciated by those skilled in the art, the reduced number of interlacings without any associated increase in yarn counts, translates into reduced fabric stability. Accordingly, it is expected that the length of the join area will need to be increased for construction where the pick and/or end counts are the same as that used in the illustration with respect to FIG. 1. As the pick and/or end count is increased the crimps per square inch will increase, and the length of the join area will again be reduced.

In determining the length of the join area, it has been found that the approximate join length in the machine direction can be approximated within plus or minus three percent by the equation, approximate join length equals 500 divided by the crimps per square inch. As noted previously, the crimps per square inch must be calculated based upon the weave construction and the number of ends in the repeat. The number 500 is a base line which has been arrived at based upon analysis that indicates that a plain weave fabric having 270 crimps per square inch will require a minimum 1.86 inch join length in order to provide an acceptable strength level in the join area. However, it appears that a minimum 2 inch join length is necessary to provide yarn distribution and a proper work area. While a minimum 2 inch join may provide acceptable strength, a layer length is preferred in order to provide additional safeguards against joint failures.

Figure 4:
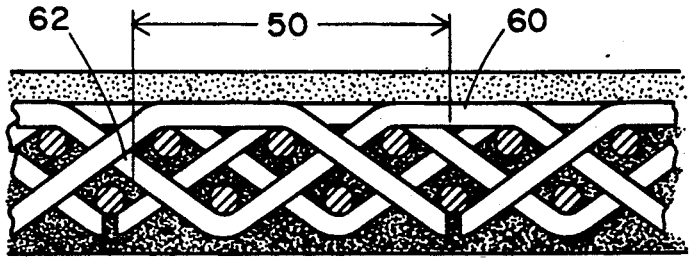
FIG. 4 is similar to FIG. 1 and illustrates the invention in a multi-ply fabric.

With respect to FIG. 4, there is shown a multi-layer construction. The multi-layer construction of FIG. 4 is fully described in U.S. Pat. 4,892,781. The constructions of U.S. Pat. No. 4,892,781 lend themselves to joining in accordance with the invention and a description of those constructions is incorporated herein as if fully set forth, with respect to FIG. 4, it will be noted that the crimp length extends from the middle of the float as indicated 60 to the point of transition as indicated at 62. As will be appreciated by those skilled in the art, the increased crimp length means that there will be generally less crimps available per inch of a duplex or multiply fabric. However, such duplex or multiply fabrics often incorporate higher end counts and tighter weaved constructions. In any event, the approximation equation set forth above applies equally to such multiple constructions. Likewise, it can be seen from FIG. 4 that the join area may be on the machine side of the fabric.

We claim:

1. An endless papermakers wet press felt having a flat woven base fabric, woven in a repeated pattern with crimped machine direction yarns that result in a number of crimps per square inch of the machine direction yarns and joined endless through a rewoven join, the machine direction length of the join, in inches, is approximated by the equation:

approximate join length equals 500 divided by the crimps per square inch in the repeat pattern of the base fabric.

2. An endless papermakers wet press felt having a flat woven base fabric, woven in a given repeat pattern with crimped machine direction yarns that have a plurality of crimps in each square inch of the repeat pattern, and rendered endless through a rewoven join; the minimum machine direction join length, in inches, is approximated by the equation:

approximate join length equals 500 divided by the crimps per square inch in the repeat pattern of the woven base fabric.

3. An endless felt of the type having a flat woven base fabric, woven in a given repeat pattern having a plurality of machine direction yarn crimps in each square inch of the repeat pattern, rendered endless through a rewoven join; the minimum machine direction join length, in inches, of the join is approximated by the equation:

approximate join length equals 500 divided by the crimps per square inch in the repeat pattern of the woven base fabric and the actual machine direction join length does not exceed 2.5 times the approximated join length.

4. A method of determining the minimum join length required for joining endless a wet press felt of the type having a flat woven base fabric which was woven in a given repeat pattern including crimped machine direction yarns, the method comprising the steps of;

(a) determining the number of machine direction crimps in one square inch of the flat woven base fabric; and (b) solving the equation:

$$\frac{500}{\text{the number of crimps per square inch as determined in step (a)}},$$

whereby the resultant equals the minimum join length.

* * * * *

UNITED STATES PATENT AND TRADEMARK OFFICE

CERTIFICATE OF CORRECTION

PATENT NO. : 5,167,262

DATED : December 1, 1992

INVENTOR(S) : Bennett et al.

It is certified that error appears in the above-indentified patent and that said Letters Patent is hereby corrected as shown below:

column 1, line 49, delete "same" and insert therefor --seam--.

column 3, line 52, delete "thirty, six" and insert therefor --thirty-six--.

column 4, line 25, delete "layer" and insert therefor --larger--; at line 34, delete ", with" and insert therefor --. With--.

IN THE DRAWINGS

In FIG. 1, on the left hand side, delete "0" and insert therefor --10--.

Signed and Sealed this

Nineteenth Day of October, 1993

*Attest:*

*Attesting Officer*

Bruce Lehman

BRUCE LEHMAN

*Commissioner of Patents and Trademarks*